US010094212B2

(12) United States Patent
Shanks

(10) Patent No.: US 10,094,212 B2
(45) Date of Patent: Oct. 9, 2018

(54) DATA COMMUNICATIONS SYSTEM

(71) Applicant: Zenith Oilfield Technology Limited, Inverurie, Aberdeenshire (GB)

(72) Inventor: David Sirda Shanks, Aberdeen (GB)

(73) Assignee: ZENITH OILFIELD TECHNOLOGY LIMITED, Aberdeenshire (GB)

( * ) Notice: Subject to any disclaimer, the term of this patent is extended or adjusted under 35 U.S.C. 154(b) by 243 days.

(21) Appl. No.: 14/786,661

(22) PCT Filed: Apr. 22, 2014

(86) PCT No.: PCT/GB2014/051235
§ 371 (c)(1),
(2) Date: Oct. 23, 2015

(87) PCT Pub. No.: WO2014/174266
PCT Pub. Date: Oct. 30, 2014

(65) Prior Publication Data

US 2016/0076362 A1 Mar. 17, 2016

(30) Foreign Application Priority Data

Apr. 25, 2013 (GB) ..... 1307447.1

(51) Int. Cl.
*E21B 47/12* (2012.01)
*E21B 47/16* (2006.01)
(Continued)

(52) U.S. Cl.
CPC ..... *E21B 47/12* (2013.01); *E21B 47/16* (2013.01); *E21B 43/127* (2013.01); *E21B 47/0008* (2013.01)

(58) Field of Classification Search
CPC ..... E21B 47/16; E21B 47/12
See application file for complete search history.

(56) References Cited

U.S. PATENT DOCUMENTS 3,788,136 A 1/1974 Park
3,790,930 A 2/1974 Lamel et al.
(Continued)

FOREIGN PATENT DOCUMENTS

EP 0882870 A2 12/1998

OTHER PUBLICATIONS

Combined Search and Examination Report issued in connection with corresponding GB Application No. GB1307447.1 dated Oct. 22, 2013.
(Continued)

*Primary Examiner* — D. Andrews
*Assistant Examiner* — Kristyn A Hall
(74) *Attorney, Agent, or Firm* — GE Global Patent Operation

(57) ABSTRACT

A data communications system and method for transmitting data over a string between a surface location and a sub-surface location in a well bore in which a load varying device at the sub-surface varies the mechanical load on the string to be indicative of the data and a load measuring apparatus at surface monitors the mechanical load on the string and decodes the data. Data transmission is described from a pump assembly through a sucker rod string. Embodiments of load varying devices using electrical generators, friction rollers and hydraulic and pneumatic brakes are also described.

20 Claims, 6 Drawing Sheets

(51) Int. Cl.

| | |
|---|---|
| *E21B 43/12* | (2006.01) |
| *E21B 47/00* | (2012.01) |

(56) References Cited

U.S. PATENT DOCUMENTS

| | | | | |
|---|---|---|---|---|
| 3,805,606 | A | | 4/1974 | Stelzer et al. |
| 3,837,223 | A | | 9/1974 | Richter, Jr. et al. |
| 5,224,834 | A | | 7/1993 | Westerman et al. |
| 5,592,438 | A | * | 1/1997 | Rorden |
| 5,819,849 | A | | 10/1998 | Booth |
| 2008/0240930 | A1 | * | 10/2008 | Palka |
| 2010/0110833 | A1 | * | 5/2010 | Close |
| 2012/0020808 | A1 | | 1/2012 | Lawson et al. |

OTHER PUBLICATIONS

International Search Report and Written Opinion issued in connection with corresponding PCT Application No. PCT/GB2014/051235 dated Mar. 9, 2015.

* cited by examiner

DATA COMMUNICATIONS SYSTEM

CROSS-REFERENCE TO RELATED APPLICATIONS

This is a national stage application under 35 U.S.C. § 371(c) of prior filed, copending PCT application serial number PCT/GB2014/051235, filed on Apr. 22, 2014, which claims priority to Great Britain Patent Application Serial No. 1307447.1 filed Apr. 25, 2013 and titled DATA COMMUNICATIONS SYSTEM. The above-listed applications are herein incorporated by reference.

BACKGROUND OF THE INVENTION

Embodiments of the invention relate to data transmission to and from down hole equipment and in particular, though not exclusively, to a data communication system and a method of data transmission through a sucker rod string between the sub-surface and a surface location of a well bore.

In the exploration and production of oil and gas wells, well bores are drilled from the surface to a subsurface location to access the reserves. The well bore is typically 'cased' with tubing to prevent collapse. A string can be run into the well bore to position down hole equipment at a sub-surface location. Down hole equipment is understood to refer to any tool, equipment or instrument that is used in a well bore.

Data needs to be transmitted between down hole equipment and the surface for various reasons. For example, monitoring performance of motors/pumps; transmission of control signals for control of valves; measuring device orientation and position, and making physical measurements. Power may also need to be transmitted to the down hole monitoring equipment. Due to the complexity of construction and the depths which wells are drilled, the data is sent to surface without installing dedicated cables and power for the down hole instrumentation is also sent without adding wires to the well equipment.

Telemetry systems are known which use the casing to transmit electromagnetic and acoustic data signals from a sub-surface location to a surface location. Such systems typically cannot achieve transmission of power from surface to sub-surface.

An embodiment of the present invention provides an alternative wireless system and method of data transmission when an electrical cable is not present in the well bore. In an embodiment of the present invention an alternative system and method of power transfer is also described.

SUMMARY OF THE INVENTION

According to a first aspect of the present invention there is provided a data communications system for transmitting data over a string between a surface location and a sub-surface location in a well bore, the data communications system comprising a sub-surface system module including load varying means to vary mechanical load on the string to be indicative of the data and a surface system module including load measuring apparatus to monitor the mechanical load on the string and a processor for determining the data from variation in the load.

In this way, the data is coupled onto the string by varying the mechanical load on the string using a force modulating device. The variation in mechanical load is applied in a way that can be read as information at the surface. The system therefore provides wireless transmission of data between the surface and sub-surface.

In an embodiment, the string is a sucker rod string. In this way data can be transmitted from surface driven down hole equipment, such as a PCP, plunger pump, or sucker rod pump system. In this embodiment, the sub surface module alters the mechanical force required to operate the pump in such a way as to convey measured sub surface data, and the surface module measures and decodes this mechanical load change. The effect of the mechanical pumping system on the data signal integrity can be minimised.

In an embodiment, the load varying means comprises a power generator module which is used to alter the mechanical loading on the string. The load varying means is an electrical generator with a variable electrical load which alters the mechanical loading of the string. The electrical generator may be a linear or rotary electrical generator. Alternatively, the load varying means may comprise a mechanical or hydraulic brake with a control mechanism. The brake may be a linear or rotary roller wheel with variable friction. Alternatively, the brake may be a linear stroking hydraulic piston with variable chokes on the hydraulic fluid feed or outlet which vary the force and thus the mechanical load on the string. Optionally, the brake may be a rotary acting hydraulic piston or motor with variable chokes on the hydraulic fluid feed or outlet which varies the force required to rotate the assembly.

In an embodiment, the load varying means varies the load in a 'high-low' pattern to form bits representative of single bit data. The 'high-low' pattern may be an 'on-off' pattern. In this way, the data is sent as single bit data. Alternatively, the data may be sent in binary bit strings using NRZ or any other encoding scheme. Where the data is sent in binary bit strings, which may be encoded, the binary bit strings are also configured as PN sequences to improve signal to noise ratio.

In an embodiment, the load varying means is mounted above a pump assembly being assembled and installed in the same way as the pump assembly. In this way, the sub-surface module can be fitted to any standard pump assembly using sucker rod mechanical drive from surface.

In an embodiment, the load measuring apparatus comprises a detection system at surface to measure the changes in the mechanical loading created by the sub-surface module. The detection system may be a load cell, pressure sensing device, bending beam, or use the current sense from the pump drive motor.

In an embodiment, the sub-surface module includes one or more gauges to make down hole measurements. More particularly, the load varying means is used to power at least one electronics module in the one or more gauges. In an embodiment, the one or more gauges have a power module. The power module may derive power from the load generator and store and regulate this power sufficient to run the at least one electronics module in the one or more gauges. Power can thus be maintained on the down hole monitoring instrumentation if the main sucker rod drive has stopped, which provides essential information in the event of pump shut downs or other major events in the well.

In an embodiment, the load varying means may be directly dependent on temperature or pressure. In this way, the mechanical load on the string is directly affected by pressure or temperature so providing a simple direct method of measuring the down hole environment.

According to a second aspect of the present invention there is provided a method of transmitting data on a string between a surface location and a sub-surface location in a well bore, comprising altering a mechanical load on the string at the subsurface location, the load being altered to convey data, monitoring the change in mechanical load on the string at the surface and decoding the data.

In this way, data signals are be transmitted from the sub-surface to the surface via the string.

In an embodiment, the method includes the step of sending the data as a single bit data stream. Alternatively, the data may be sent in binary bit strings using NRZ or any other encoding scheme. Where the data is sent in binary bit strings, which may be encoded, the binary bit strings are also configured as PN sequences to improve signal to noise ratio.

In this way, data signals can be transmitted from the sub-surface to the surface through the string via a wireless alternating load transmitter.

In an embodiment, the data is transmitted over a sucker rod string in a mechanical pump drive. The method includes the step of applying a change in the mechanical load during a selected part of the pump cycle. In this way, the time period where the load changes are applied is easier to detect.

The selected part of the pump cycle is when the load from the pump drive action is steady. In this way, changes to the mechanical load can be more easily seen. The selected part of the pump cycle is when the load on the sucker rod string is lowest. In this way, the changes will appear larger as compared to the background loads.

The method includes the step of varying the load during the down stroke on a sucker rod pump. This will improve the signal to noise ratio.

Optionally, the method includes the step of varying the load during the upstroke. In this way, rod string buckling is prevented.

The method includes the step of varying the load at a relatively high frequency. In this way, the data signal transmission can be differentiated more readily from background pump noise.

BRIEF DESCRIPTION OF THE DRAWINGS

The present invention will now be described, by way of example only, with reference to the accompanying drawings, in which:

FIG. 5(*b*) being a further embodiment of a data transmission system; and FIG. 3(*c*) being a yet further embodiment of a data transmission system.

DETAILED DESCRIPTION

Figure 1:
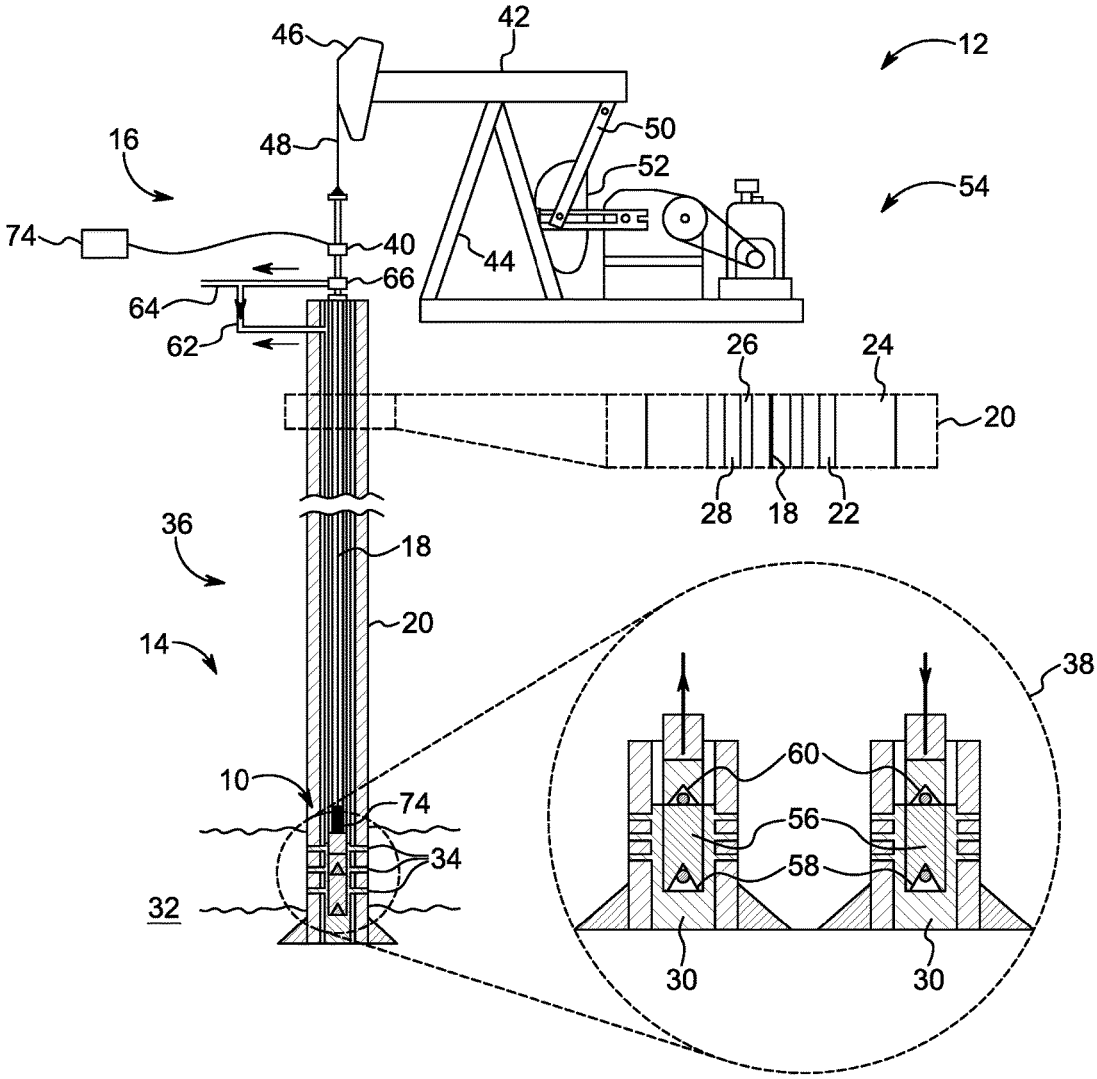
FIG. 1 shows a typical set up of down hole equipment in a well, in the form of a rod pump completion.

Reference is initially made to FIG. 1 of the drawings which illustrates a data transmission system, generally indicated by reference numeral 10, located within a well 12, to transmit data from a sub-surface location 14 to a surface location 16 through a string 18 located in the well 12, according to an embodiment of the present invention.

Well 12 is a typical oil, gas or water well in which a well bore 20 is drilled and lined with casing 22 held in place by cement 24. Tubing 26 is inserted in the casing 22, providing an annulus 28 therebetween. Oil 30 from an oil bearing zone or reservoir 32 in the sub-surface 14, enters the tubing 26 through perforations 34 in the casing, to travel to the surface 12. When the reservoir pressure is insufficient to lift the oil 30 to the surface 16, it is common to provide down hole equipment in the form of an artificial lift system. Types of artificial lift systems include hydraulic pumps, Rod pumps, Electric Submersible Pumps (ESPs), Jet Pumps, Progressing-Cavity pumps (PCPs) and gas lift. FIG. 1 of the drawings illustrates a typical rod pump completion 36 in a well bore 20.

The completion 36 consists of a down hole pump assembly 38 in the oil producing section of the reservoir 32. This pump 38 is deployed on a tubing string 26 and driven mechanically by a sucker rod string 18. A rod pump completion 36 provides a reciprocating pump 38 driven from the surface 16 by drive units which move a polished rod 18 through a stuffing box 40. A main walking beam 42 is pivotally mounted on a Samson post 44 with one end providing a horse head 46 with a bridle 48 attached to the polished rod 18. The opposing end is connected to a pitman arm 50 and crank 52 which are coupled to a motor drive and gearbox assembly 54 to reciprocate the walking beam 42.

On reciprocation of the walking beam 42, the rod string 18 is stroked up and down through the stuffing box 40. At the end of the rod 18, arranged at the perforations 34, is a pump barrel 56 including a standing valve 58 and a travelling valve 60 connected to the end of the rod 18. Each stroke lifts the oil into the tubing 26. At the surface 16, the lifted oil and gas can be siphoned off via a gas line 62 and an oil line 64 from a tee 66.

While a rod pump completion 36 can be considered as relatively simple technology, they are expensive to maintain and repair. Consequently, monitoring is required in order to ensure correct operation and, most importantly, avoid a pump off condition. This occurs when an insufficient amount of fluid enters the pump barrel 56 on a downstoke. On the next downstroke, the travelling valve 60 and rod 18 impact the fluid in the pump barrel 56, sending shock waves through the assembly 38 causing damage. Additionally, it is beneficial if the motor and drive unit 54 can be controlled so that the rod 18 reciprocates and drives the pump at maximum efficiency. The majority of current control systems are limited to monitoring the position of the polished rod 18 in the stuffing box 40 to infer conditions at the pump barrel 56.

In an embodiment of the present invention, one or more down hole gauges are mounted sub-surface 14 in the vicinity of the pump barrel 56 and the data from these gauges is transmitted to surface 16 via a data transmission system 10.

Figure 2:
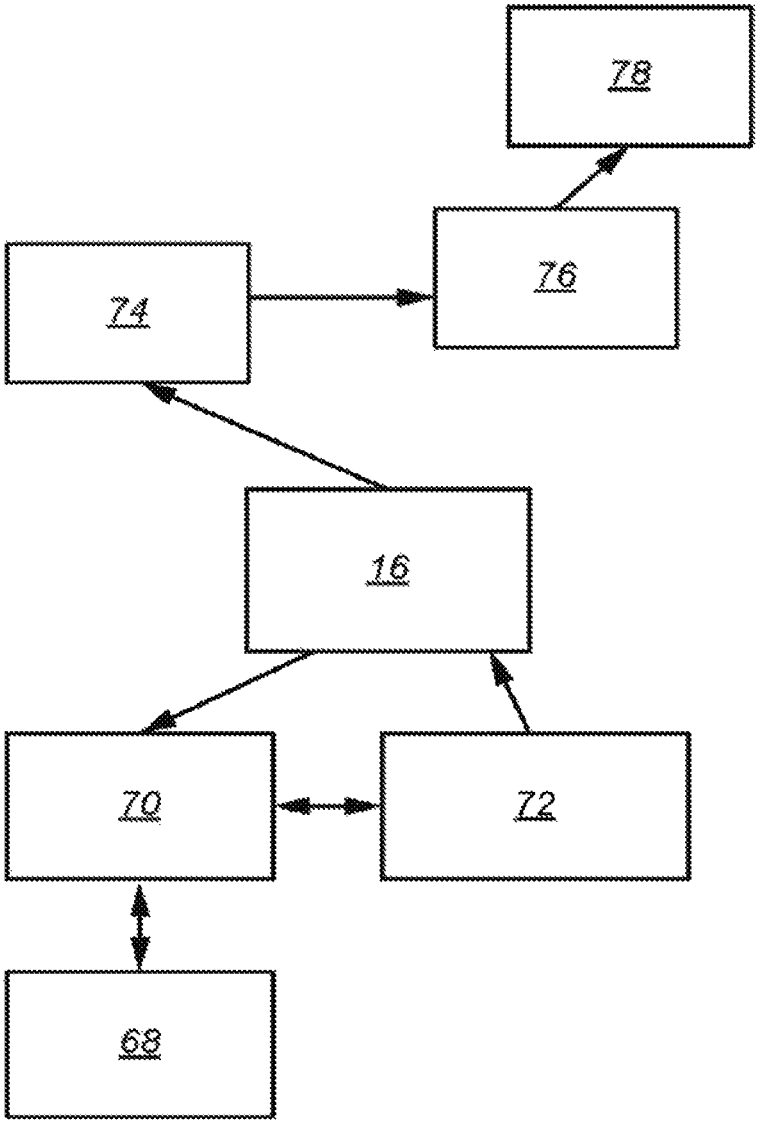
FIG. 2 shows a schematic block diagram of a data communication system according to a first embodiment of the present invention.

Referring now to FIG. 2 of the drawings there is illustrated a functional block diagram of a data transmission system 10. Located sub-surface 14 is a measurement module 68 which measures any required parameter of the pumping system 38, such as pressures temperatures, vibration and fluid presence. The measurement module 68 is powered by a power regulator module 70, which also transmits the measured data to a load modulating device 72, all located sub-surface 14. There is a mechanical transmission in the form of a string 18, between sub-surface 14 and surface 16. The load modulating device 72 acts on the string 18 in response to the data. Located at the surface 16 is a measurement device 74 which senses the variation in the mechanical load on the string 18. The measurement device 74 may be a load cell, pressure gauge or optical sensing device. A processor 76 decodes the sensed load variations and generates readings of the data measured in the measurement module 68. There may be an optional display or computer logging system 78 where the information system is presented to an operator and/or stored for future review.

Figure 3:
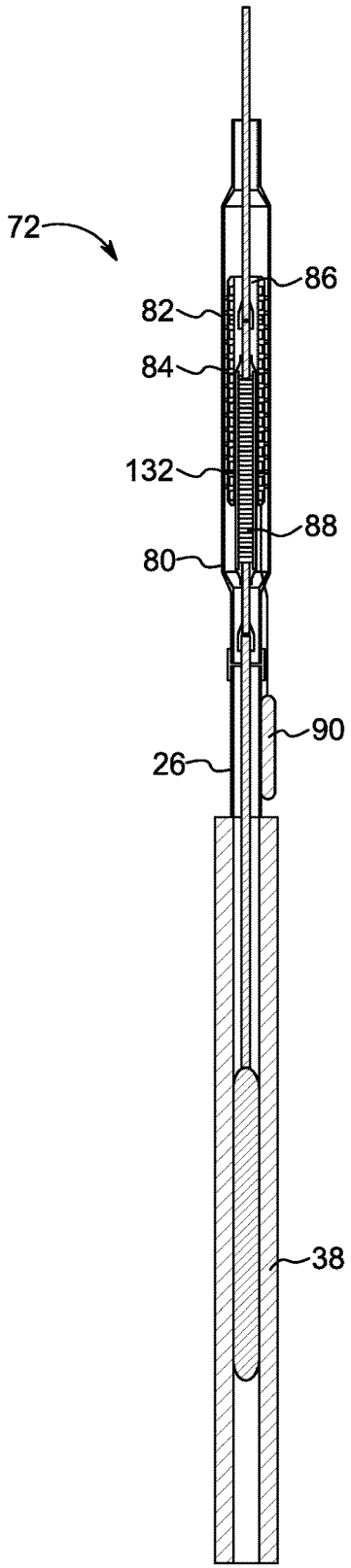
FIG. 3 shows an illustration of a down hole pump assembly including a data transmission system according to an embodiment of the present invention.

Reference is now made to FIG. 3 of the drawings which illustrates the sub-surface components of a data transmission system 10 fitted to a down hole pump assembly 38. Mounted in the tubing 26 above the down hole pump assembly 38 is a load modulating device 72. Device 72 has a substantially cylindrical housing 80 with an outer diameter in an embodiment no greater than that of the pump 38. Within the housing 80 there is arranged a stator 82. Stator 82 is a cylindrical arrangement of static windings 84 providing a bore 86 therethrough. The stator 82 is attached to the body 80 as described herein after with reference to FIGS. 6(*a*) and (*b*). Located upon the rod string 18 in the vicinity of the stator 82 is an actuator 88 in the form of a magnetic core. The magnetic core comprises multiple magnets 132 arranged around and along the rod 18. A down hole electronics module 90 is also arranged on the tubing 26 between the load modulating device 72 and the down hole pump assembly 38. The tubing 26 has a narrower diameter in this region to accommodate the down hole electronics module 90 in a manner as is known in the art. The down hole electronics module 90 contains the measurement module 68 and the power regulator module 70.

In use, device 72 and the electronics module 90 are arranged on the tubing 26 when the tubing 26 is run in the well bore 20 to locate the down hole pump assembly 38 at the reservoir 32. The actuator 88 is located in the sucker rod string 18. With the data transmission system 10 in place, the pump assembly 38 can be operated as normal. When measurements are required, the measurement module 68 operates gauges and/or other sensors to record the desired parameters such as temperature, pressure, vibration and fluid presence. Recorded data is transferred into bits and the signal transmitted to the power regulator module 70. The power regulating module 70 then controls the load modulating device 72 to vary the force between the stator 82 and actuator 88 such that the mechanical load on the rod 18 varies in response to the data signal. Thus an increase in load may signify a bit equal to 'one' and a decrease in load may signify a bit equal to 'zero'. At the surface 16, the measurement device 74 will monitor the change in load and the processor 76 will decode the load variations and reconstruct the data signal from the measurement module 68. Data signals from different gauges may be sent in series by this method.

This provides transmission of a single bit data stream. However, the data may be sent in binary bit strings using NRZ or any other encoding scheme. Also, where the data is sent in binary bit strings, which may be encoded, the binary bit strings may also be configured as PN sequences to improve the signal to noise ratio.

The electronics module 90 may monitor the pump cycle and transmit the data at a selected part of the pump cycle so that the time period where the load changes are applied is easier to detect at the surface 16. Choosing the selected part of the pump cycle to be when the load from the pump drive action is steady will give changes to the mechanical load which can be more easily seen. Taking the selected part of the pump cycle when the load on the sucker rod string is lowest ensures that the changes will appear larger as compared to the background loads. Transmitting data by varying the load during the down stroke on a sucker rod pump will improve the signal to noise ratio. Conversely, transmitting data by varying the load during the upstroke will prevent rod string buckling.

Additionally, if the load is varied at a relatively high frequency compared to the stroke frequency, the data signal transmission can be differentiated more readily from background pump noise.

Figure 4A:
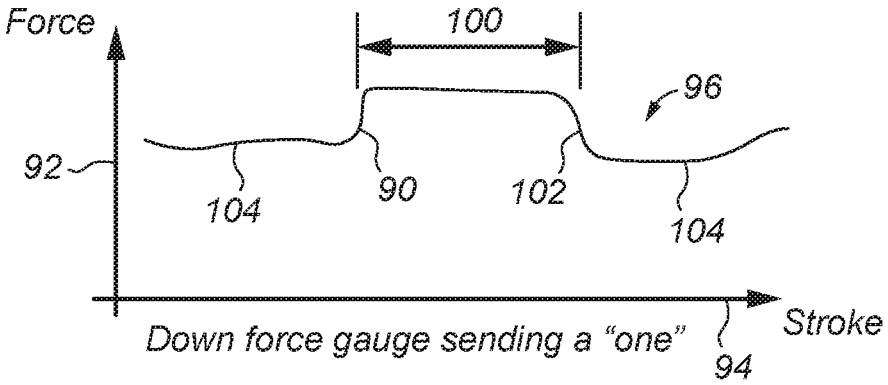
FIGS. 4(*a*) and 4(*b*) are graphs illustrating a transmitted binary signal in the form of a '1', FIG. 4(*a*), and a '0', FIG. 4(*b*), according to an embodiment of the present invention.
Figure 4B:
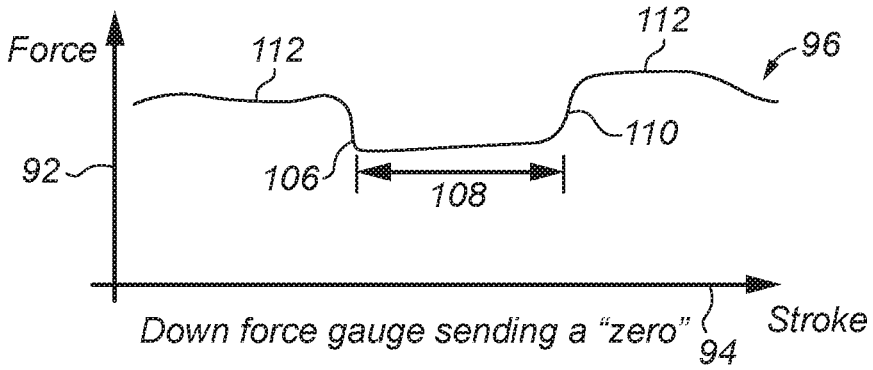

Reference is now made to FIGS. 4(*a*) and (*b*) which illustrate the data decoding from the load measurement. In FIG. 4(*a*), the force or load 92 on the string 18 is measured against time on the stroke 94. The trace 96 shows an increase 90, which begins at a selected time in the pump cycle, is held for a period of time 100, before decreasing 102 back to its starting level 104. This can be considered as transmission of a 'one' in binary code. Similarly the inverse can be performed to provide transmission of a binary sequence. In FIG. 4(*b*), transmission of a 'zero' can be achieved by decreasing 106 the load at a preselected time in the cycle period, for a period of time 108, before increasing 110 back to its starting level 112. Clearly depending on the physical size of the pumping system and the depth it may be possible to send more than one bit of information per pump stroke, so the data speed can be anywhere from a single bit as illustrated to many bytes per pump stroke.

It is also realised that in passing the actuator 88 through the bore 86 of the stator 82, the effect of passing a magnetic field through a set of electromagnetic windings 84 can generate an electric current. This current is transmitted to the power regulator module 72 where it can be stored and used to power the gauges and sensors in the measurement module 68. With the ability to store power down hole, the measurement gauges and sensors can operate when the pump when the main sucker rod drive 54 has stopped which provides essential information in the event of pump shut downs or other major well events.

Figure 5A:
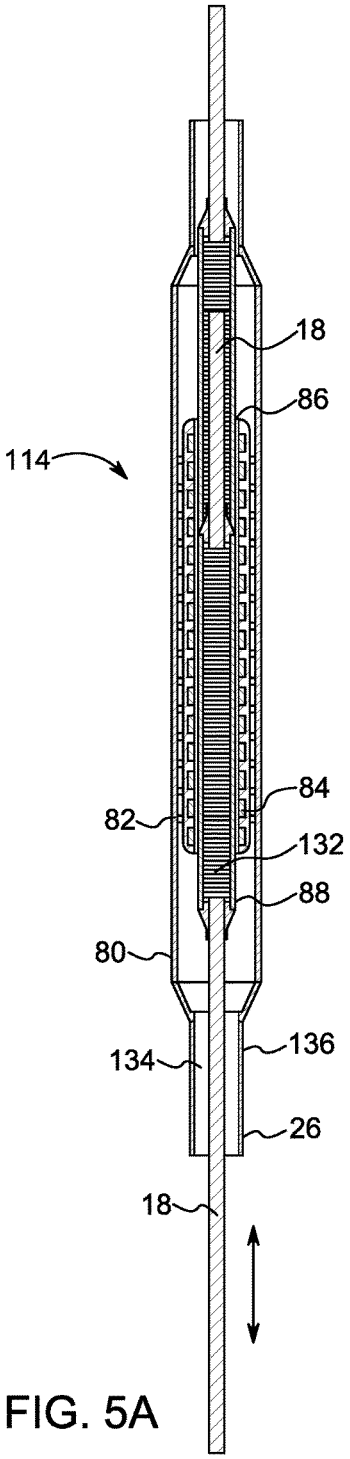
FIGS. 5(*a*)-(*c*) illustrate data transmission systems, with FIG. 5(*a*) being the data transmission system of FIG. 3.
Figure 5B:
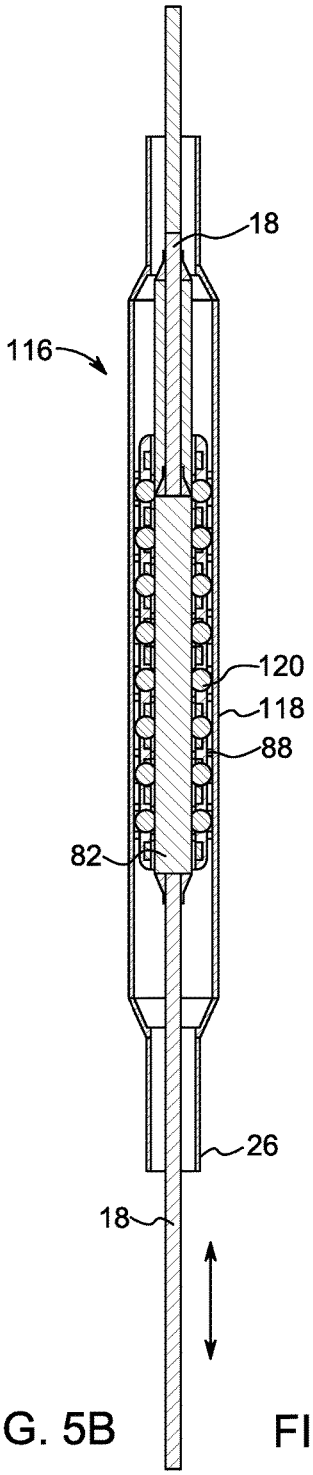
Figure 5C:
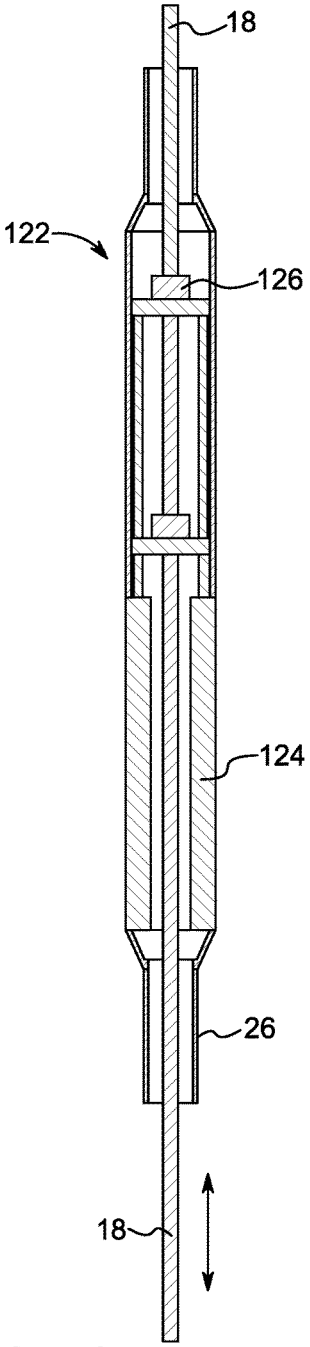

Referring now to FIGS. 5(*a*) to (*c*), there is shown embodiments of load varying devices. Those skilled in the art will recognise that these do not form an exhaustive list but are merely illustrative of the types of devices available. FIG. 5(*a*) shows a load varying device, generally indicated by reference numeral 114, being an electromagnetic linear generator according to the embodiment of a data transmission system as presented and described with reference to FIG. 3. Actuator 88 provides a magnetic core on the rod 18 which is stroked within a static electromagnetic winding 84 allowing power to be drawn from the load varying device 114. Also, by altering the electrical loading, the force required to operate the pump (not shown) can be altered.

FIG. 5(*b*) shows a load varying device, generally indicated by reference numeral 116, based on a mechanical brake according to the embodiment of a data transmission system. Body 80 has the same outer diameter as the device 114. On an inner surface 118 of the body 80, there are arranged roller contacts 120. The roller contacts 120 are arranged to make frictional contact with the rod 18 as it passes through the body 80. The body 80 can be considered as a central bearing tube with a mechanism for altering the force which the roller contacts 120 apply to the shaft of the rod 18. Altering the force will vary the load upon the rod 18 which can be decoded at the surface 16. In this way data is transmitted to the surface 16. The device 116 can also contain a mechanically driven power generator to allow electrical power to be used for local electronics down hole.

FIG. 5(*c*) shows a load varying device, generally indicated by reference numeral 122, based on a hydraulic brake according to the embodiment of a data transmission system. In this device 122, hydraulic or pneumatic pistons 124 are used to provide a load. The sucker rod 18 is latched onto this system through a mechanical latch 126 allowing the pistons 124 to act directly on the rod string 18. Thus by varying the pistons 124 position, the load is varied upon the string 18. If data is coupled onto the pistons 124 by varying their position, this load variation can be read at surface 16 and decoded to derive the data. Power can be generated by using a small linear generator in the same outline as one of the pistons, or by adding a small turbine generator to the hydraulic or pneumatic circuit of one or all of the pistons.

Figure 6A:
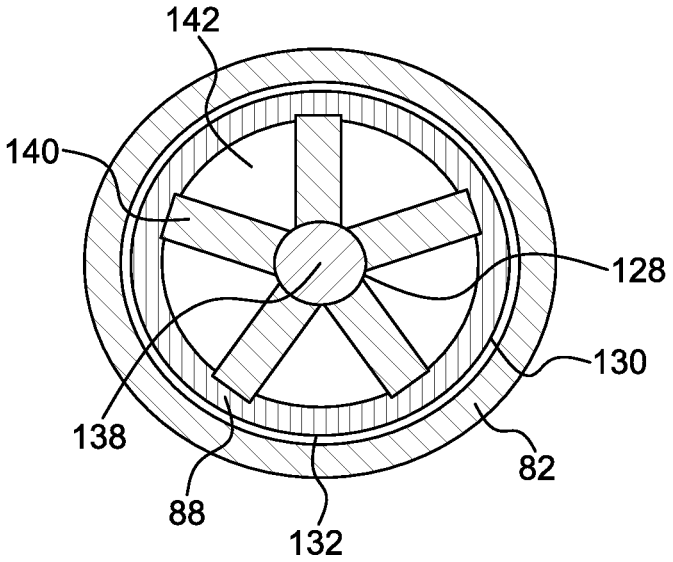
FIGS. 6(*a*) and 6(*b*) show configurations of data transmission systems to provide fluid flow in a well bore according to embodiments of the present invention
Figure 6B:
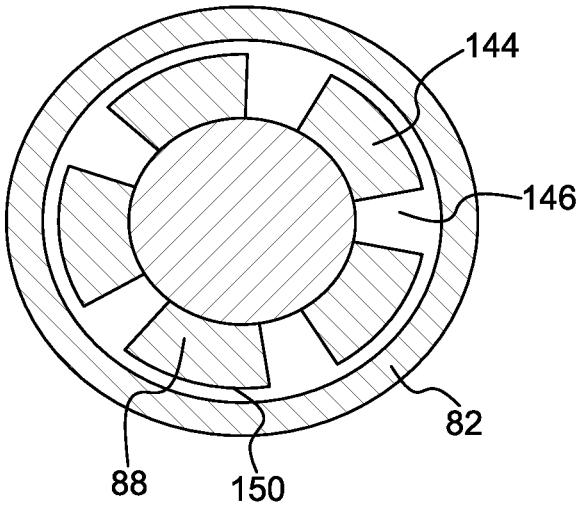

It will be realised that the load varying devices 114, 116, 122 require to operate in the tubing 26 without restricting the flow of fluid from the pump assembly 38 which is being lifted to the surface 16. Thus fluid must be able to flow past each device 114, 116, 122. Additionally, a compromise between clearance and wear must be made as while a smaller clearance between the actuator and stator will increase the power transfer, it will also increase the chances of sticking and wear. Referring now to FIGS. 6(*a*) and (*b*) there are illustrated schematic cross-sectional views through load varying devices according to further embodiments of a data transmission system which achieve the required fluid bypass.

Referring initially to FIG. 6(*a*), the outer stator 82 is shown as an annular tube which is static. The actuator 88 provides a moving magnetic or mechanical centre piece 128. The centre piece 128 has an annular outer wall 130 upon which is arranged the active parts such as magnets 132 or roller contacts 120. These active parts are designed to occupy a space outside the nominal bore 134 of the production tubing 136, and inside the static section 82 of the device 114,116,122. A central support 138 connects into the rod 18 having support spindles 140 to the outer wall 130. Spaces 142 between the spindles 140 allow the fluid to flow freely through the centre of the device 114,116,122 while maintaining a small clearance between the outer wall 130 and the stator 82 for good power transfer. This structure would also allow wiper seals to be used between the stroking part 88 and the static section 82 to assist in preventing debris from getting into the moving surfaces.

An alternative arrangement is shown in FIG. 6(*b*). In this Figure the stator 82 remains the same. The central support 138 now has a larger diameter which can accommodate parts of the actuator 88 if required. The active parts are now located in wings 144 located around the edge of the central support 138. Bypass channels 146 are present between the wings 144 to provide for fluid flow through the device 114,116,122. The outer edge 150 of each wing 144 is arranged to be rounded and provide a small clearance with the stator 82 to give good power transfer.

In a yet further embodiment the load varying device is formed from a material sensitive to temperature or pressure so that the load on the string is directly dependent on temperature or pressure which the device is exposed to. In this way temperature or pressure can be read at the surface without requiring any power generator down hole.

An embodiment of the present invention provides a system and method of data transfer between sub-surface and a surface location of a well bore using the already present string in the well bore.

An embodiment of the present invention provides a wireless system and method of data transfer between sub-surface and a surface location in a well bore.

An embodiment of the present invention provides a wireless system and method of power transfer to down hole equipment in a well bore.

It will be apparent to those skilled in the art that various modifications may be made to the invention herein described without departing from the scope thereof. For example, other load varying devices may be considered as may the system and method be applied to other instrumentation on a string within a well bore. Additionally, though the string in the present invention has been described as a tubular string, coiled tubing and wireline strings may also be considered.

What is claimed is:

1. A data communications system for transmitting data over a string between a surface location and a sub-surface location in a well bore, said data communications system comprising:

a sub-surface system module including a load varying means to vary mechanical load on the string to be indicative of the data; and a surface system module including load measuring apparatus to monitor the mechanical load on the string and a processor for determining the data from variation in the load, wherein the mechanical load is varied by varying a force between a stator and an actuator of the load varying means.

2. The data communications system according to claim 1, wherein the string is a sucker rod string.

3. The data communications system according to claim 1, wherein the load varying means comprises a power generator module which is used to alter the mechanical loading on the string.

4. The data communications system according to claim 1, wherein the load varying means is an electrical generator with a variable electrical load which alters the mechanical loading of the string.

5. The data communications system according to claim 1, wherein the load varying means comprises a mechanical or a hydraulic brake with a control mechanism.

6. The data communications system according to claim 1, wherein the load varying means varies the load in a high-low pattern to form bits representative of single bit data.

7. The data communications system according to claim 6, wherein the data is sent in binary bit strings using an encoding scheme.

8. The data communications system according to claim 6, wherein the data is sent in binary bit strings which are configured as PN sequences to improve signal to noise ratio.

9. The data communications system according to claim 1, wherein the load varying means is mounted above a pump assembly being assembled and installed in the same way as the pump assembly.

10. The data communications system according to claim 1, wherein the load measuring apparatus measures the changes in the mechanical loading created by the sub-surface module.

11. The data communications system according to claim 1, wherein the sub-surface module includes one or more gauges to make down hole measurements.

12. The data communications system according to claim 1, wherein the load varying means is directly dependent on temperature or pressure which can be read at surface.

13. A method of transmitting data on a string between a surface location and a sub-surface location in a well bore, comprising:

altering a mechanical load on the string at the subsurface location by a load varying means, the load being altered to convey data;

monitoring the change in mechanical load on the string at the surface; and decoding the data, wherein the mechanical load is changed by varying a force between a stator and an actuator of the load varying means.

14. The method of transmitting data according to claim 13, wherein the method further includes sending the data as a single bit data stream.

15. The method of transmitting data according to claim 13, wherein the method further comprises sending the data in binary bit strings using an encoding scheme.

16. The method of transmitting data according to claim 13, wherein the method further comprises sending the data over a sucker rod string in a mechanical pump drive.

17. The method of transmitting data according to claim 16, wherein the method further comprises applying a change in the mechanical load during a selected part of the pump cycle.

18. The method of transmitting data according to claim 17, wherein the selected part of the pump cycle is when the load from the pump drive action is steady.

19. The method of transmitting data according to claim 17, wherein the selected part of the pump cycle is when the load on the sucker rod string is lowest.

20. The method of transmitting data according to claim 13, wherein the method further comprises varying the load at a relatively high frequency.

* * * * *